US006871637B2

(12) United States Patent
Tsuchiya et al.

(10) Patent No.: US 6,871,637 B2
(45) Date of Patent: Mar. 29, 2005

(54) FUEL DELIVERY RAIL ASSEMBLY

(75) Inventors: Hikari Tsuchiya, Gotenba (JP); Yoshiyuki Serizawa, Mishima (JP); Tetsuo Ogata, Shizuoka (JP); Kazuteru Mizuno, Numazu (JP); Kazunori Takikawa, Numazu (JP)

(73) Assignee: Usui Kokusai Sangyo Kaisha Ltd., Shizuoka (JP)

( * ) Notice: Subject to any disclaimer, the term of this patent is extended or adjusted under 35 U.S.C. 154(b) by 20 days.

(21) Appl. No.: 10/426,834

(22) Filed: May 1, 2003

(65) Prior Publication Data

US 2004/0000291 A1 Jan. 1, 2004

(30) Foreign Application Priority Data

May 8, 2002 (JP) ..... 2002-132345
Nov. 21, 2002 (JP) ..... 2002-337383

(51) Int. Cl.[7] ..... F02M 37/04
(52) U.S. Cl. ..... 123/467; 123/456
(58) Field of Search ..... 123/467, 456, 123/468, 469, 447; 138/30, 29, 28, 115, 26, 116, 27, 111

(56) References Cited

U.S. PATENT DOCUMENTS 3,872,891 A * 3/1975 Chamberlain ..... 138/177
4,474,160 A * 10/1984 Gartner ..... 123/468
4,649,884 A 3/1987 Tuckey
4,660,524 A 4/1987 Bertsch et al.
5,056,489 A * 10/1991 Lorraine ..... 123/468
5,299,542 A * 4/1994 Hafner ..... 123/470
5,575,262 A * 11/1996 Rohde ..... 123/467
5,845,621 A * 12/1998 Robinson et al. ..... 123/456
6,354,273 B1 3/2002 Imura et al.
6,615,801 B1 * 9/2003 Zdroik ..... 123/467

* cited by examiner

*Primary Examiner*—Carl S. Miller
(74) *Attorney, Agent, or Firm*—Wenderoth, Lind & Ponack, L.L.P.

(57) ABSTRACT

A fuel delivery rail assembly for supplying fuel to a plurality of fuel injectors in an engine is provided. The assembly includes an elongate conduit having a longitudinal fuel passage therein, a fuel inlet pipe, and a plurality of sockets. One wall of the conduit opposite to the socket mounting wall includes a flat or arcuate flexible absorbing surface. A high-frequency noise suppressing device such as a binding member is fixed within the conduit for connecting the one wall and the socket mounting wall. The binding member includes is comprised of a pipe, a bar or a rigid block. The binding member may be a body portion of an extending socket terminating with the one wall. Thus, fuel pressure pulsations and shock waves are reduced by bending of the absorbing surface, and emission of high-frequency noise is eliminated.

3 Claims, 7 Drawing Sheets

FUEL DELIVERY RAIL ASSEMBLY

BACKGROUND OF THE INVENTION

This invention relates to a fuel delivery rail assembly for an internal combustion engine, especially for an automotive engine, equipped with an electronic fuel injection system. The fuel delivery rail assembly delivers pressurized fuel supplied from a fuel pump toward intake passages or chambers via associated fuel injectors. The assembly is used to simplify installation of the fuel injectors and the fuel supply passages on the engine. In particular, this invention relates to sectional constructions of a fuel conduit (fuel rail) having a fuel passage therein and connecting constructions between the conduit and sockets for receiving fuel injectors.

Fuel delivery rails are popularly used for electronic fuel injection systems of gasoline engines. There are two types of fuel delivery rails; one is a return type having a return pipe and another is a non-return (returnless) type. In the return type, fuel is delivered from a conduit having a fuel passage therein to fuel injectors via cylindrical sockets and then residual fuel goes back to a fuel tank via the return pipe. Recently, for economical reasons, use of the non-return type is increasing and new problems are arising therefrom. That is, due to pressure pulsations and shock waves which are caused by reciprocal movements of a fuel pump (plunger pump) and injector spools, the fuel delivery rail and its attachments are vibrated thereby emitting uncomfortable noise.

U.S. Pat. No. 6,354,273 (Imura et al.) discloses a fuel delivery rail assembly including at least one flat or arcuate flexible absorbing surface. However, in case that one wall of the conduit opposite to the socket mounting wall is providing the absorbing surface, it tends to emit high-frequency noise, which may be caused by mechanical vibratory resonance.

U.S. Pat. No. 4,660,524 (Bertsch et al.) discloses a fuel supply line having an elastic wall section connected to a rigid wall section.

U.S. Pat. No. 4,649,884 (Tuckey) discloses a fuel rail having a flexible metal membrane which absorbs pulsations created by injectors.

SUMMARY OF THE INVENTION

It is an object of the present invention to provide a fuel delivery rail assembly which can reduce the pressure fluctuations within the fuel passages caused by fuel injections, and also to reduce the vibrations caused by fuel reflecting waves (shock waves), to thereby eliminate emission of uncomfortable high-frequency noise.

A conventional type of fuel delivery rail assembly comprises an elongate conduit having a longitudinal fuel passage therein, a fuel inlet pipe fixed to an end or a side of the conduit, and a plurality of sockets vertically fixed to the conduit adapted to communicate with the fuel passage and so formed as to receive tips of fuel injectors at their open ends.

According to the characteristics of the invention, one wall of the conduit opposite to the socket mounting wall includes a flat or arcuate flexible absorbing surface. In addition, high-frequency noise suppressing means are applied to the inner surfaces of the conduit as follows:

(A) A binding member is fixed within the conduit for connecting said one wall and the socket mounting wall.
(B) The binding member is comprised of a pipe, a circular bar or a square bar.

(C) The binding member is comprised of a curved plate having curved ends.
(D) The binding member is comprised of a rigid block traversing the interior space of the conduit.
(E) The binding member is comprised of a body portion of an extending socket terminating with said one wall.

As a result of the above construction of the invention, in a fuel delivery rail assembly having a fuel conduit made by steel, stainless steel or press materials, it has been found that it becomes possible to eliminate emission of uncomfortable noise including high-frequency noise. These noise are caused by the vibration and pressure pulsations due to the reflecting waves of injections and lack of dampening performance of the conduit.

In a theoretical principle, when shock waves produced by the fuel injections flow into the fuel inlet of the sockets or flow away therefrom by momentary back streams, the flexible absorbing surface absorbs the shock and pressure pulsations. In addition, when thin plates having small spring constant are deflected and deformed, the space of contents varies, namely expands or shrinks, thereby absorbing pressure fluctuations.

Further, the high-frequency noise suppressing means work to prevent the absorbing surface from vibrating freely and emitting high-frequency noise. Thus, a high-frequency sound component contained in the noise is minimized and diffusion of high-frequency noise is considerably eliminated.

Under the continuous experiments, following arrangements are found to be most preferable to obtain best results.

(1) The binding member is fixed near one end or each end of the conduit in its longitudinal direction in order to deviate from the maximum bending position of the absorbing surface.
(2) The number of the binding member is one to three.
(3) The thickness of the absorbing surface is equal to or less than the thickness of other surfaces of the conduit.
(4) The radius of a curvature at an edge of the absorbing surface is more than two times of the thickness of the absorbing surface.

In this invention, thickness of each wall of the conduit, ratio of the horizontal size to the vertical size, and the range of clearance between the fuel inlet of the socket and its confronting surface are preferably defined by experiments or calculations such that, especially during idling of the engine, the vibrations and pressure pulsations are minimized.

Since the present invention is directed essentially to the sectional construction of the conduit and connecting construction of the conduit and the sockets, interchangeability with the prior fuel delivery rails are maintained as far as the mounting dimensions are kept constant.

Other features and advantages of the invention will become apparent from descriptions of the embodiments, when taken in conjunction with the drawings, in which, like reference numerals refer to like elements in the several views.

DESCRIPTION OF THE PREFERRED EMBODIMENT

Figure 1A:
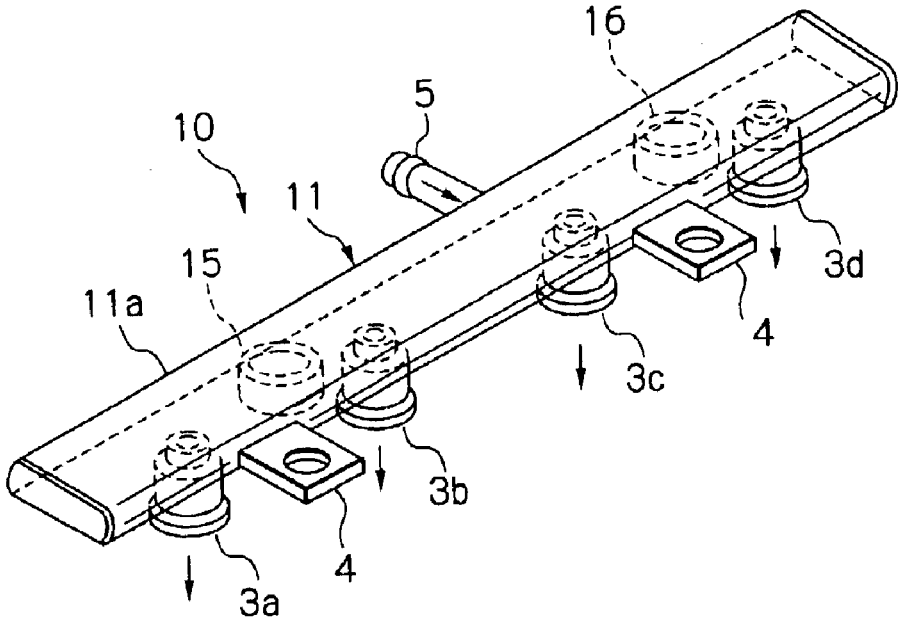
FIG. 1A is a perspective view.
Figure 1B:
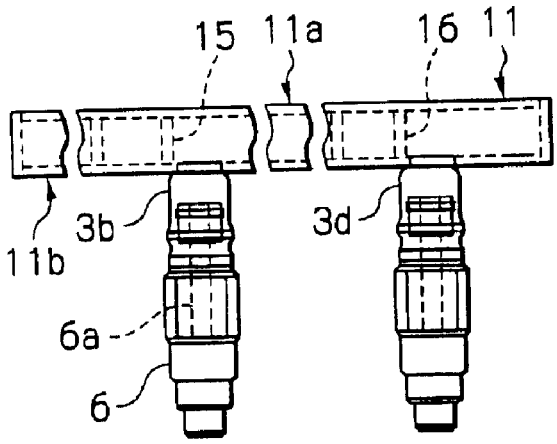
FIG. 1B is a side view and FIG. 1C is a vertical sectional view of a first type of fuel delivery rail assembly according to the invention.
Figure 1C:
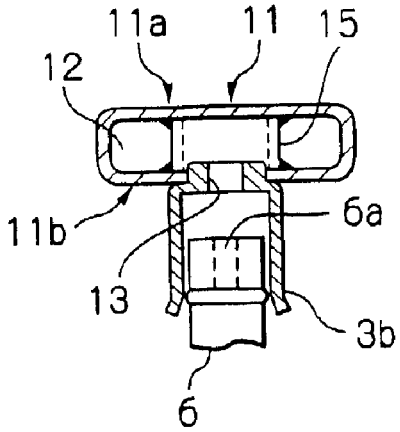

Referring to FIGS. 1A to 1C, there is shown a first embodiment of the present invention, a fuel delivery rail assembly 10 of the so called "top feed type", adapted to an automotive four-cylinder engine. The fuel conduit (rail) 11 comprised of flat steel pipes extends along a longitudinal direction of a crank shaft (not shown) of an engine.

At the bottom side of the conduit 11, four sockets 3*a*–3*d* for receiving tips of fuel injectors are located corresponding to the number of cylinders at predetermined angles and distances from each other. To the conduit 11, two thick and rigid brackets 4 are fixed transversely so as to mount the assembly 10 onto the engine body. Fuel flows along the arrows thereby being discharged from the sockets 3*a*–3*d* and fuel injectors (not shown) into an air intake passage or cylinders of the engine.

At the side of the conduit 11, a fuel inlet pipe 5 is fixed by brazing or welding. Although at an end of the conduit 11 it is possible to provide a fuel return pipe for transferring residual fuel back to a fuel tank, the present invention is directed to a non-return type having fuel pressure pulsation problems, so that the fuel return pipe is not provided.

As shown in FIG. 1C, the conduit 11 has a flat rectangular section such that a circular steel pipe or stainless steel pipe is pressed into a flat form. The vertical and horizontal dimensions of the conduit 11 can be defined such that each wall thickness is 1.2 mm, the height is 10.2 mm, the width is 28 to 34 mm.

Based upon the charasteristics of the present invention, one wall 11*a* of the conduit 11 opposite to the socket mounting wall 11*b* provides a flat flexible absorbing surface 11*a*. Since the absorbing surface 11*a* faces to the fuel inlet port 13 of the socket 3, it can absorb shock and vibration during fuel injection timing.

In addition, two pipes 15, 16 are fixed within the conduit 11 by brazing or welding for connecting the wall 11*a* and the socket mounting wall 11*b*. These pipes work to restrain free movements of the confronting walls. The dimensions of each pipe 15, 16 can be defined such that its diameter is about 10 to 80 percent of the width of the conduit 11.

As it is understood from FIG. 1C, shock waves emitted from a fuel supply port 6*a* of the injection nozzle 6 pass through the fuel inlet port 13 of the socket and run against the absorbing surface 11*a*, thereby being dampened. During this action, the pipes 15, 16 work to minimize a high-frequency sound component from the vibration noise. Thus, diffusion of high-frequency noise is considerably eliminated.

Figure 2:
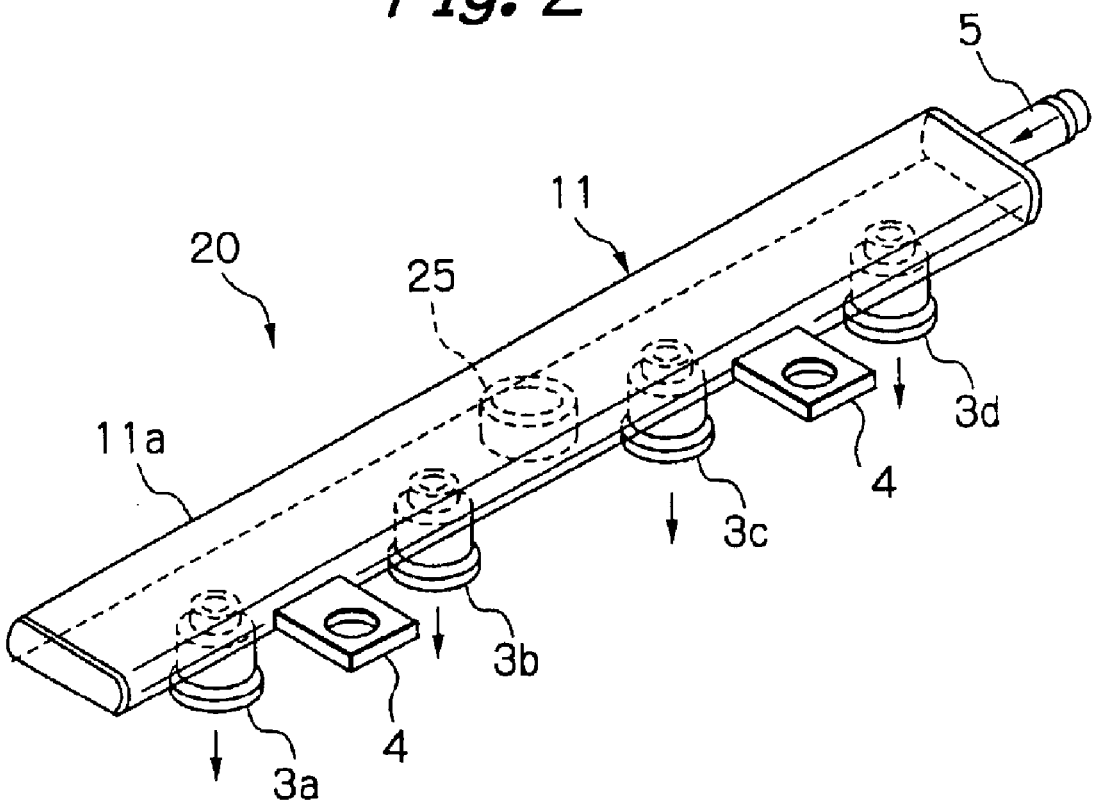
FIG. 2 is a perspective view of a modified assembly.

FIG. 2 illustrates a fuel delivery rail assembly 20 according to a modified embodiment of the invention. In this embodiment, only one pipe 25 is located near the mid-point of the longitudinal conduit 11. Further, the fuel inlet pipe 5 is fixed to a distal end of the conduit 11.

Depending upon a configuration of the fuel rail, the number of pipes can be selected and optimized by continuous experiments.

Figure 3A:
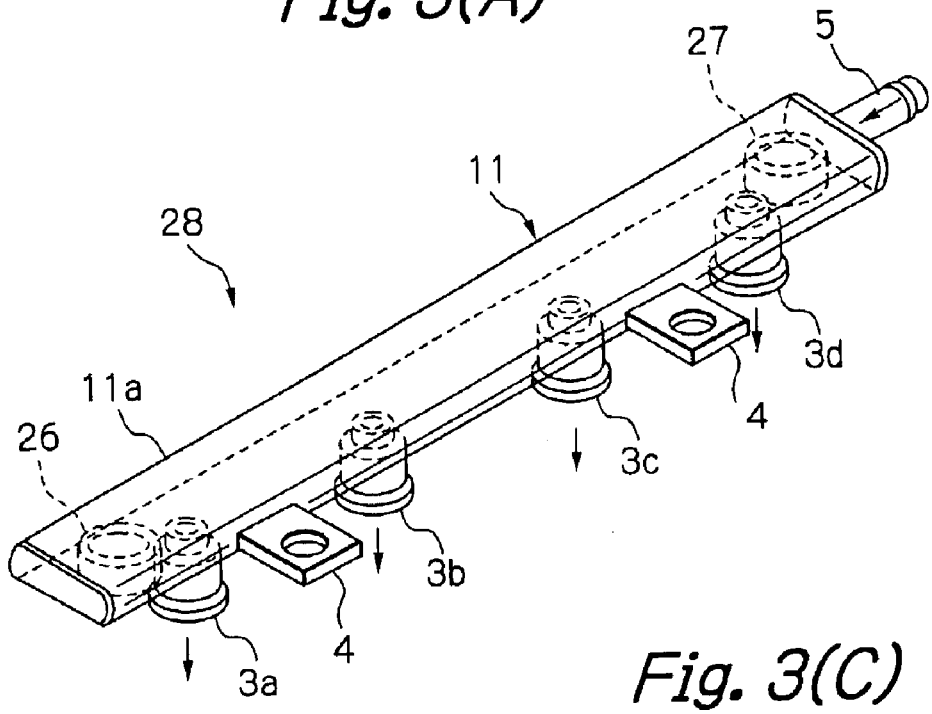
FIGS. 3A to 3C are perspective views of further modified assemblies.
Figure 3C:
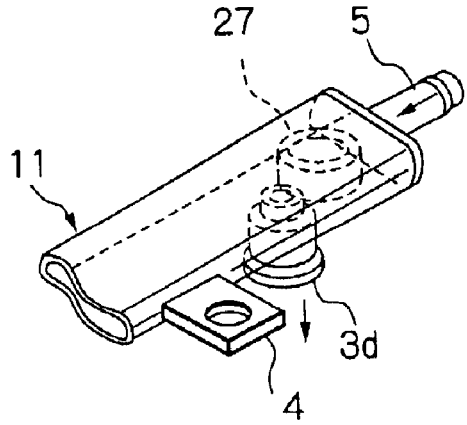
Figure 3B:
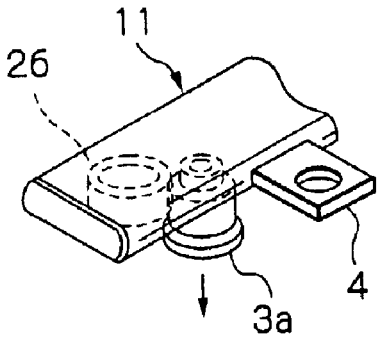

FIGS. 3A to 3C illustrate further modified embodiments in which one pipe or two pipes are located near one end or each end (both ends) of the conduit 11. In FIG. 3A, two pipes 26, 27 are located near each end of the conduit 11. In FIG. 3B, one pipe 26 is located near the free end of the conduit 11. In FIG. 3C, one pipe 27 is located near the fuel inlet end of the conduit 11. According to some experiments, it has been found that the pipe position near the end of the conduit 11 can provide the most effective performance.

Figure 4:
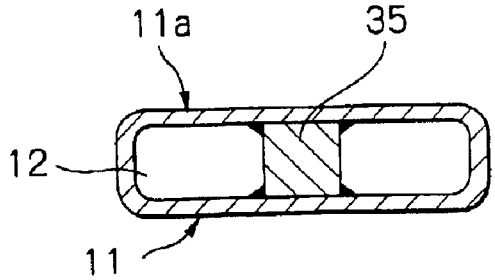
FIG. 4 is a vertical sectional view of a second type fuel delivery rail assembly.

Referring to FIG. 4, there is shown a second embodiment of the present invention. The absorbing surface 11*a* can absorb shock and vibration during fuel injection timing. The binding member is comprised of a solid bar 35 having a circular or a square section. The solid bar 35 also works to minimize a high-frequency sound component from the vibration noise.

Figure 5A:
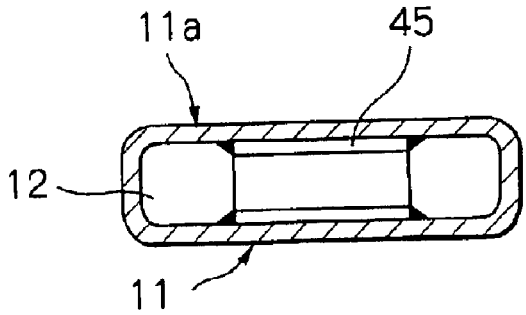
FIGS. 5A and 5B are vertical sectional views of a third type fuel delivery rail assembly.
Figure 5B:
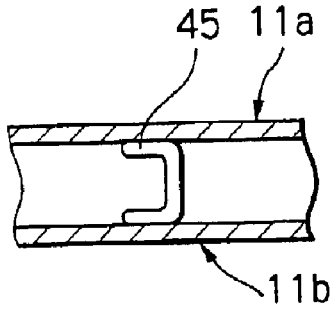

Referring to FIGS. 5A and 5B, there is shown a third embodiment of the present invention. The absorbing surface 11*a* can absorb shock and vibration during fuel injection timing. The binding member is comprised of a channel-like curved plate 45 having flange-like curved ends which are prepared for easy welding or brazing. The plate 45 also works to minimize a high-frequency sound component from the vibration noise.

Figure 6A:
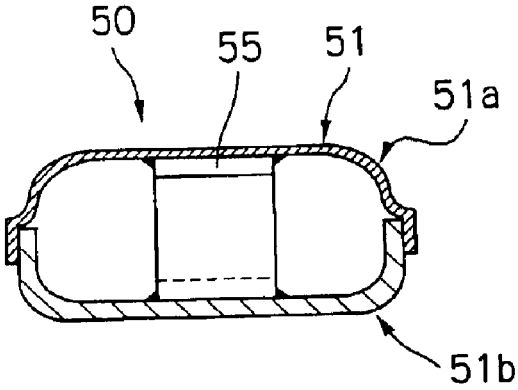
FIGS. 6A and 6B are vertical sectional views of a fourth type fuel delivery rail assembly.
Figure 6B:
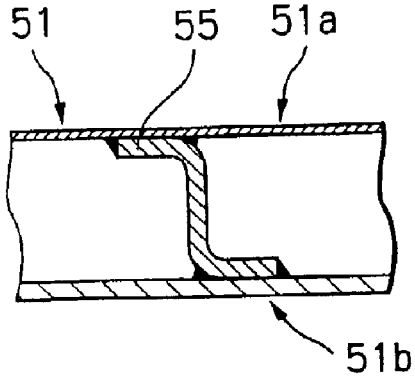

Referring to FIGS. 6A and 6B, there is shown a fourth embodiment of the present invention, a fuel delivery rail assembly 50. The conduit 51 comprises an arcuate wall 51*a* and a relatively thick wall 51*b* connected together. The wall 51*b* is also a socket mounting wall. The wall 51*a* provides a flexible absorbing surface 51*a* which can absorb shock and vibration during fuel injection timing. The binding member is comprised of a crank-like curved plate 55 having flange-like curved ends which are prepared for easy welding or brazing. The plate 55 also works to minimize a high-frequency sound component from the vibration noise.

Figure 7A:
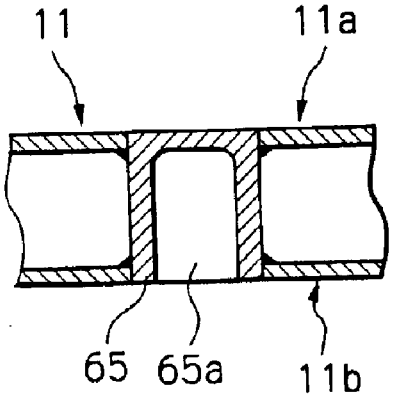
FIG. 7A is a vertical sectional view.
Figure 7B:
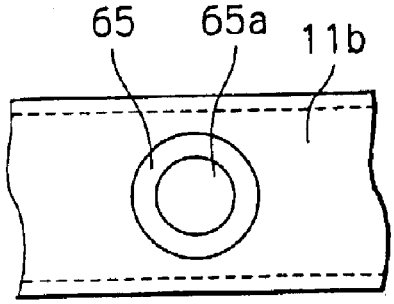
FIG. 7B is a bottom view of a further modified embodiment.

FIGS. 7A and 7B illustrate a further modified embodiment in which the binding member is comprised of a U-cup pipe 65. In its center, a cavity 65*a* is prepared for reducing the weight of the assembly. The pipe 65 also works to minimize a high-frequency sound component from the vibration noise.

Figure 8A:
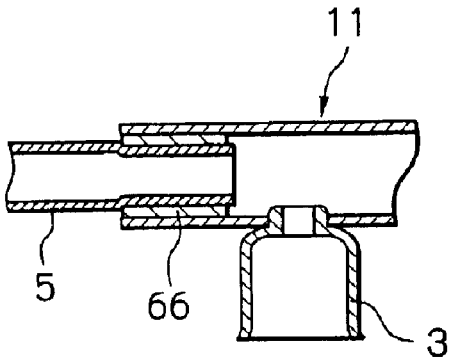
FIGS. 8A to 8D are vertical sectional views of further modified assemblies.
Figure 8B:
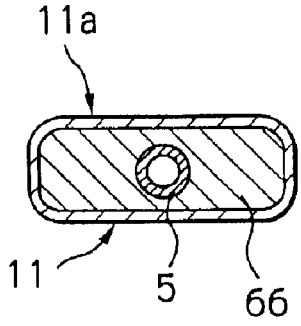
Figure 8C:
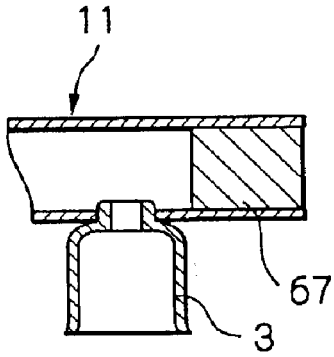
Figure 8D:
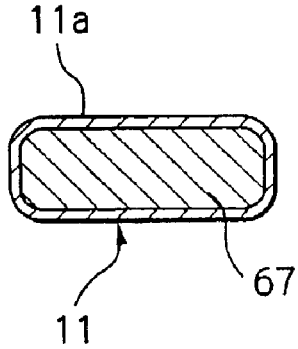

FIGS. 8A to 8D illustrate further modified embodiments in which the binding member is comprised of a rigid block traversing the interior space of the conduit. In FIGS. 8A and 8B, a rigid block 66 is located at the inlet pipe end of the conduit 11 enclosing the inlet pipe 5 and traversing the interior space of the conduit. In FIGS. 8C and 8D, a rigid block 67 is located at the free end of the conduit 11 traversing the interior space of the conduit thereby working as an end cap. The blocks 66, 67 also work to minimize a high-frequency sound component from the vibration noise.

Figure 9A:
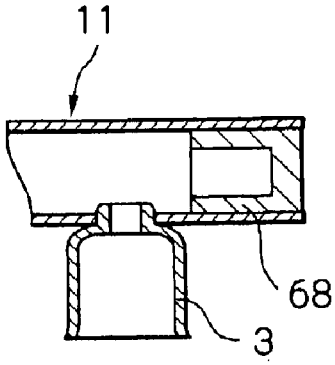
FIGS. 9A and 9B are vertical sectional views of a further modified assembly.
Figure 9B:
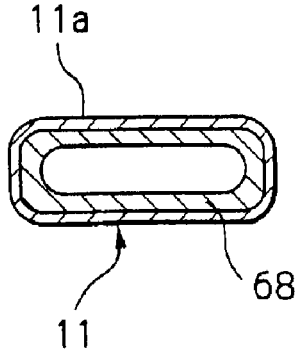

FIGS. 9A and 9B illustrate a further modified embodiment in which a traversing block 68 is provided with a central hollow portion for reducing the weight of the assembly. The block 68 also works to minimize a high-frequency sound component from the vibration noise.

Figure 10A:
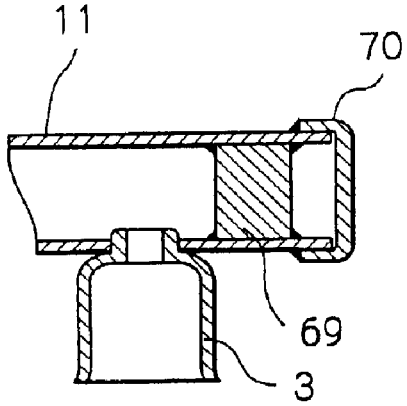
FIGS. 10A and 10B are vertical sectional views of a further modified assembly.
Figure 10B:
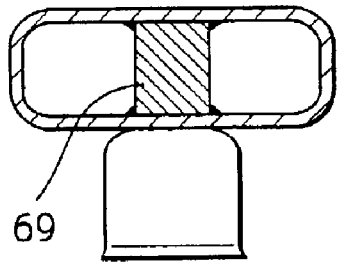

FIGS. 10A and 10B illustrate a further modified embodiment in which the binding member is comprised of a square bar 69 located near an end cap 70 of the conduit 11. The square bar 69 also works to minimize a high-frequency sound component from the vibration noise.

Figure 11A:
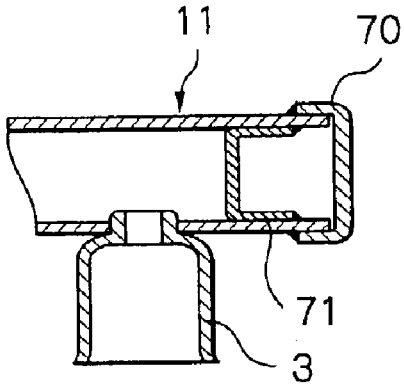
FIGS. 11A to 11D are vertical sectional views of further modified assemblies.
Figure 11B:
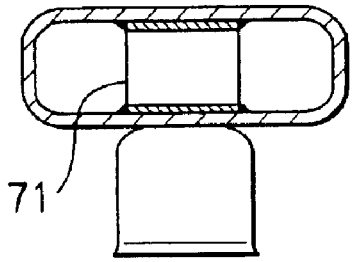
Figure 11C:
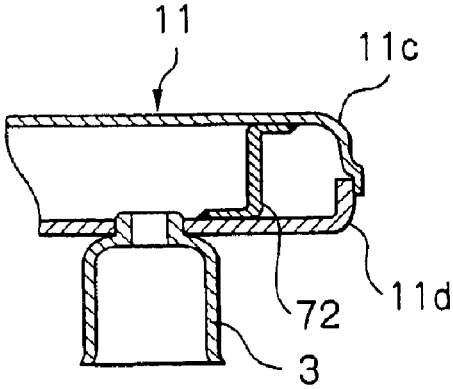
Figure 11D:
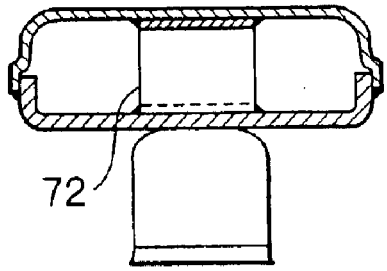

FIGS. 11A to 11D illustrate further modified embodiments in which the binding member is comprised of a curved plate. In FIGS. 11A and 11B, a channel-like curved plate 71 is located near the end cap 70 of the conduit 11. The plate 71 also works to minimize a high-frequency sound component from the vibration noise. In FIGS. 11C and 11D, the conduit 11 comprises a flexible wall 11*c* and a relatively rigid wall lid connected together. A crank-like curved plate 72 is located near a sealed end of the conduit 11. The plate 72 also works to minimize a high-frequency sound component from the vibration noise.

Figure 12A:
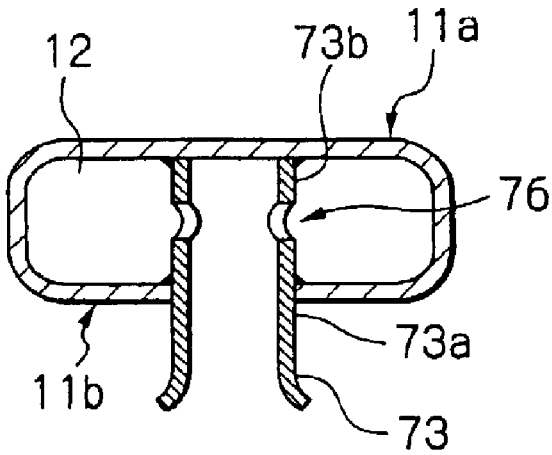
FIGS. 12A and 12B are vertical sectional views of a fifth type of fuel delivery rail assembly.
Figure 12B:
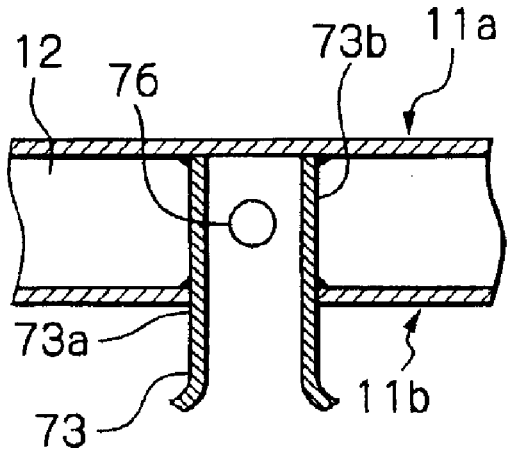

Referring to FIGS. 12A and 12B, there is shown a fifth embodiment of the present invention, in which the binding member is comprised of a body portion of an extending socket 73. The inner end 73*b* of the socket 73 is fixed to the absorbing wall 11*a*. The mid-portion 73*a* of the socket 73 is fixed to the socket mounting wall 11*b*. In addition, an opening 76 is formed within the body portion of the socket 73 in order to allow fuel communication therethrough. The body portions 73*a*, 73*b* also work to minimize a high-frequency sound component from the vibration noise.

Several experiments were done for proving the effects of the inventive binding member associated with an actual engine.

(1) Fuel delivery rail: width 34 mm, height 10.2 mm, length 300 mm, wall thickness 1.2 mm, material "Japanese industrial standard STKM11A steel pipe"

(2) Fuel supply pipe from a fuel tank to an engine: outer diameter 8 mm, wall thickness 0.7 mm, material "Japanese industrial standard STKM11A steel pipe"

(3) Engine: six cylinders gasoline engine (4) measuring points: Variations of acceleration were measured by an acceleration pickup which is located under the floor of an automobile near a connecting portion between a steel fuel supply pipe and a connecting plastic hose which is connected to the fuel inlet pipe 5.

Under the conventional phase in which the inventive binding member is not located, it was found that peak frequency components exist near 600 Hz and 1.3 kHz. Under the inventive phase in which one pipe is located near the mid-point of the longitudinal conduit, it was found that a vibration level (acceleration) was decreased by 55 percent at 600 Hz, and 30 percent at 1.3 kHz. Under the second inventive phase in which two pipes are located near both ends of the longitudinal conduit, it was found that a vibration level was decreased by 70 percent at 600 Hz, and 45 percent at 1.3 kHz.

It should be recognized that various modifications are possible within the scope of the invention claimed.

What is claimed is:

1. In a fuel delivery rail assembly for an internal combustion engine comprising:

an elongate conduit having a longitudinal fuel passage therein;

a fuel inlet pipe fixed to an end or a side of said conduit;

a plurality of sockets vertically fixed to said conduit and adapted to communicate with said longitudinal fuel passage and formed so as to receive tips of fuel injectors at their open ends, wherein one wall of said conduit opposite to the socket mounting wall includes a flat or arcuate flexible absorbing surface; and a binding member fixed within the conduit for connecting said one wall and said socket mounting wall, wherein said binding member is comprised of pipe, a circular bar, a square bar, a curved plate having curved ends or a rigid block traversing the interior space of said conduit, wherein a high-frequency noise is suppressed by said binding member and fuel pressure pulsations and shock waves are reduced by bending of said absorbing surface.

2. In a fuel delivery rail assembly for an internal combustion engine comprising:

an elongate conduit having a longitudinal fuel passage therein;

a fuel inlet pipe fixed to an end or a side of said conduit;

a plurality of sockets vertically fixed to said conduit and adapted to communicate with said longitudinal fuel passage and formed so as to receive tips of fuel injectors at their open ends, wherein one wall of said conduit opposite to the socket mounting wall includes a flat or arcuate flexible absorbing surface; and a binding member fixed within the conduit for connecting said one wall and said socket mounting wall, wherein said binding member is located near one end or each end of said conduit in its longitudinal direction, wherein a high-frequency noise is suppressed by said binding member and fuel pressure pulsations and shock waves are reduced by bending of said absorbing surface.

3. In a fuel delivery rail assembly for an internal combustion engine comprising:

an elongate conduit having a longitudinal fuel passage therein;

a fuel inlet pipe fixed to an end or a side of said conduit;

a plurality of sockets vertically fixed to said conduit and adapted to communicate with said longitudinal fuel passage and formed so as to receive tips of fuel injectors at their open ends, wherein one wall of said conduit opposite to the socket mounting wall includes a flat or arcuate flexible absorbing surface; and a binding member fixed within the conduit for connecting said one wall and said socket mounting wall, wherein said binding member is comprised of a body portion of an extending socket terminating with said one wall, wherein a high-frequency noise is suppressed by said binding member and fuel pressure pulsations and shock waves are reduced by bending of said absorbing surface.

* * * * *